United States Patent [19]

Bonn

[11] 4,169,483

[45] Oct. 2, 1979

[54] HYDRAULIC JET DRILL STEM AND BIT UNPLUGGING DEVICE

[76] Inventor: Thomas S. Bonn, P.O. Box 5601, Reno, Nev. 89513

[21] Appl. No.: 910,209

[22] Filed: May 26, 1978

[51] Int. Cl.[2] ..... B08B 3/02; B08B 9/02

[52] U.S. Cl. ..... 134/94; 134/166 C; 175/24; 175/313; 239/DIG. 10

[58] Field of Search ..... 134/166 C, 167 C, 168 C, 134/166 R, 167 R, 168 R, 102, 94, 22 R, 22 C; 175/24, 25, 313; 239/DIG. 10, 533

[56] References Cited

U.S. PATENT DOCUMENTS

| | | | |
|---|---|---|---|
| 749,374 | 1/1904 | Gates | 239/DIG. 10 |
| 2,205,938 | 6/1940 | Ward | 239/DIG. 10 |
| 2,811,975 | 11/1957 | Tatibana | 134/102 |
| 3,297,257 | 1/1967 | Roser | 134/102 |

*Primary Examiner*—George F. Mautz

*Attorney, Agent, or Firm*—Clarence A. O'Brien; Harvey B. Jacobson

[57] ABSTRACT

A device for cleaning compacted clay, fine gravels, sand, and other blocking agents from the inside of drill stems or drill bits. The device cleans away the unwanted matter by use of concentrated streams of high pressure liquid traveling at very high velocity aimed at the unwanted matter so as to erode it away. The device has one compressed gas cylinder attached to a liquid reservoir through a pressure regulating valve so as to keep the liquid in the reservoir under a constant pressure. The liquid is emitted through a nozzle containing many small holes through a pressure actuated valve. This assembly is disposed within a casing which forms a part of the drill string with the drill bit at one end of the casing. The nozzle extends to within a short distance of the drill bit. When unwanted matter is caught in the drill bit the pressure within the drill string rises above the pressure necessary to actuate the pressure actuated valve which then releases the high pressure water through the nozzle to erode away the unwanted matter.

8 Claims, 6 Drawing Figures

HYDRAULIC JET DRILL STEM AND BIT UNPLUGGING DEVICE

BACKGROUND OF THE INVENTION

1. Field of the Invention

This invention relates to devices for use in clearing clogged drill bits and drill stems.

2. Description of the Prior Art

Devices and procedures for clearing matter from stuck drilling tools are known in the prior art. These include the use of chemical erosion as disclosed for example by U.S. Pat. No. 2,900,026, issued to Trusheim. Another example of chemical erosion type process used to free stuck drill bits is U.S. Pat. No. 3,217,802, issued to Reddie et al.

Mechanical processes used to free stuck drill strings include the method of clearing away the unwanted matter by force created by hydrostatic pressure of fluid surrounding the outer wall of the drill string and bit, such as disclosed in U.S. Pat. No. 2,894,585, to Erwin. A mechanical process of vibrating dirt loose from the inside of a drill bit is taught by Jones et al, U.S. Pat. No. 2,577,895. A further method for clearing unwanted debris is taught by Conn et al, U.S. Pat. No. 3,789,861 wherein unwanted matter is cleared from a pipe by filling the pipe with water and applying a surge of high pressure to the water to purge the pipe of the unwanted matter.

SUMMARY OF THE INVENTION

An object of the present invention is to provide an unclogging device which advantageously erodes away unwanted matter which clogs drill stems and drill bits. Such a liquid erosion process operates consistently on the many varied types of matter which can be found to clog drill bits and drill stems.

Another object of the present invention is to provide a drill unclogging means which will operate in response to variation in the ambient pressure found within a drill string.

Yet another object of the present invention is to provide a means to unclog drill stems and drill bits which can be permanently affixed to the drill string without causing any blockage thereof.

A still further object of the invention is to provide an unplugging device which provides liquid to erode away unwanted matter wherein the liquid can be kept at a constant pressure at all times.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 6:
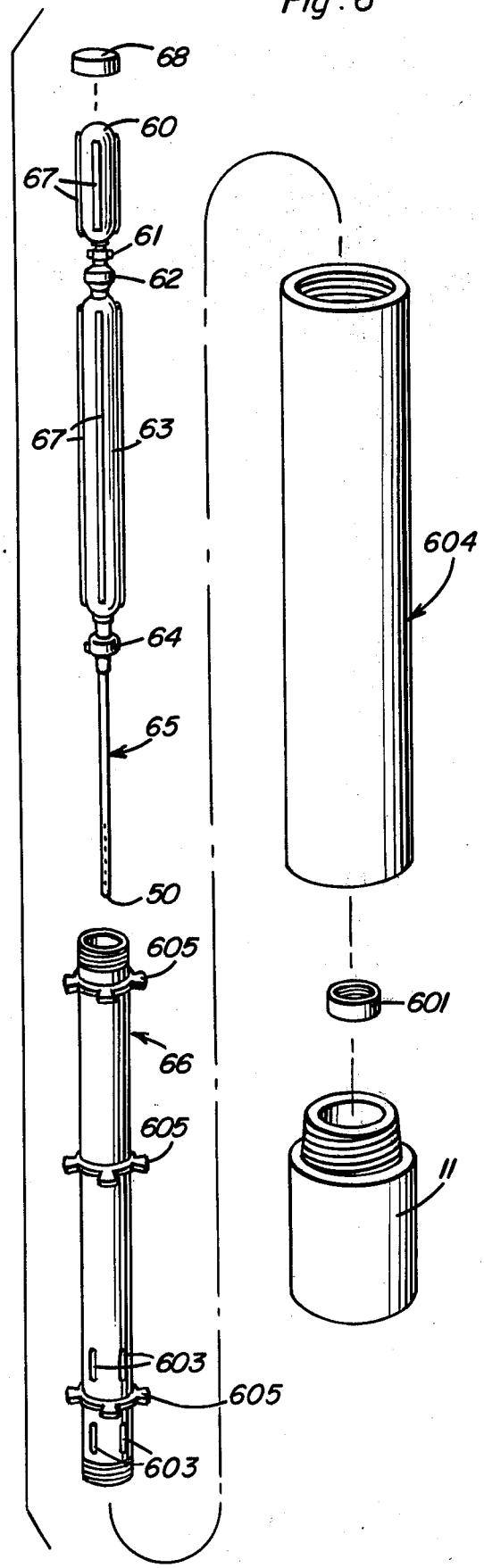
FIG. 6 is an exploded group perspective view of the device.

The invention will now be described with reference, first, to FIGS. 2 and 6. Here compressed gas cylinder 60, which contains preferably compressed air or other suitable propellant, is attached to a valve 61. Valve 61 is in turn connected to a pressure regulator 62. Pressure regulator 62 is attached to liquid storage tank 63. Liquid storage tank 63 may contain water, water with a foaming reagent, or any chemical, including one that is liquid at high pressure and gaseous at atmospheric pressure. Liquid storage tank 63 is in turn connected to a pressure actuated valve 64. Valve 64 is then in turn connected to nozzle 65. Elements 60 through 65 are all constructed out of metal or any other material capable of withstanding high pressure. These elements are connected to one another, preferably, by means of threaded engagements, however any other means of connection which would provide a tight seal under high pressure would suffice.

In operation, compressed gas cylinder 60 contains a compressed gas which is under a pressure of, for example, 4,000 psi. When valve 61 is placed in the open position, this compressed gas passes therethrough and communicates with the liquid storage tank 63 though pressure regulator 62. This pressure regulator 62 may be set to, for example, 1,000 psi. This then puts the liquid in liquid storage tank 63 under a pressure of 1,000 psi. The liquid is maintained in tank 63 until pressure actuated valve 64 is opened whereupon the pressurized liquid is forced through valve 64 into nozzle 65.

Figure 5:
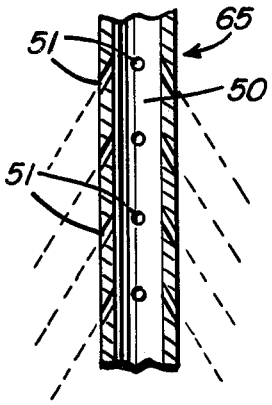
FIG. 5 is a sectional view, on an enlarged scale, of the nozzle of the device.

As can be seen with reference to FIG. 5, nozzle 65 has one main channel 50 through the center thereof. This channel 50 terminates at the end of nozzle 65 and allows a main stream of pressurized liquid to emerge therefrom at a high velocity. Also a number of smaller openings are provided in the periphery of nozzle 65. These holes 51 are drilled in the nozzle at such an angle as to allow the high pressure liquid to emerge therefrom in the same general direction as the main stream but with an included side component of velocity. The main purpose of these auxiliary backup streams is to provide flushing liquid after the main stream has eroded away the unwanted matter.

Elements 60 through 65 are conveniently slid into a mounting cylinder 66. Rubber strips 67 are spaced periodically about the circumference of compressed gas cylinder 60 and liquid storage tanks 63 in order to provide a cushion for these elements when placed inside mounting cylinder 66. End cap 68 is also provided with a rubber cushion 69 and is threadedly mounted upon the rear of mounting cylinder 66. Cap 601 is provided with a hole in the center portion thereof which allows nozzle 65 to extend therethrough. Cap 601 is also provided with a rubber cushion 602. Cap 601 is threadably engaged to forward portion of mounting cylinder 66. Mounting cylinder 66 is also provided with slots 603 which provide for the equalization of pressure within the cylinder for reasons which will become apparent hereinafter. Mounting cylinder 66 with its contents as just described is placed within the confines of casing rod 604. It is held in place and stabilized by means of a number of spiders 605. These spiders have solid ring portions which are permanently affixed to cylinder 66 on the exterior thereof and radially extending fingers which are permanently attached to the interior of casing rod 604 by means, for example, of welds.

Figure 1:
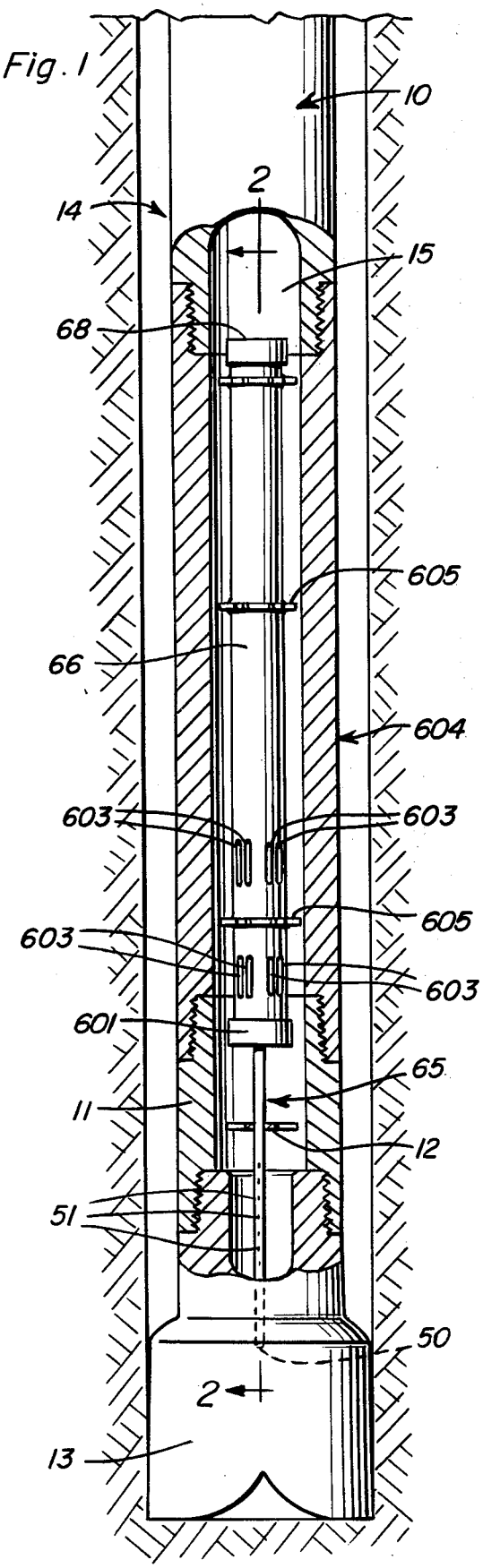
FIG. 1 is a partial sectional view of the device in use.
Figure 2:
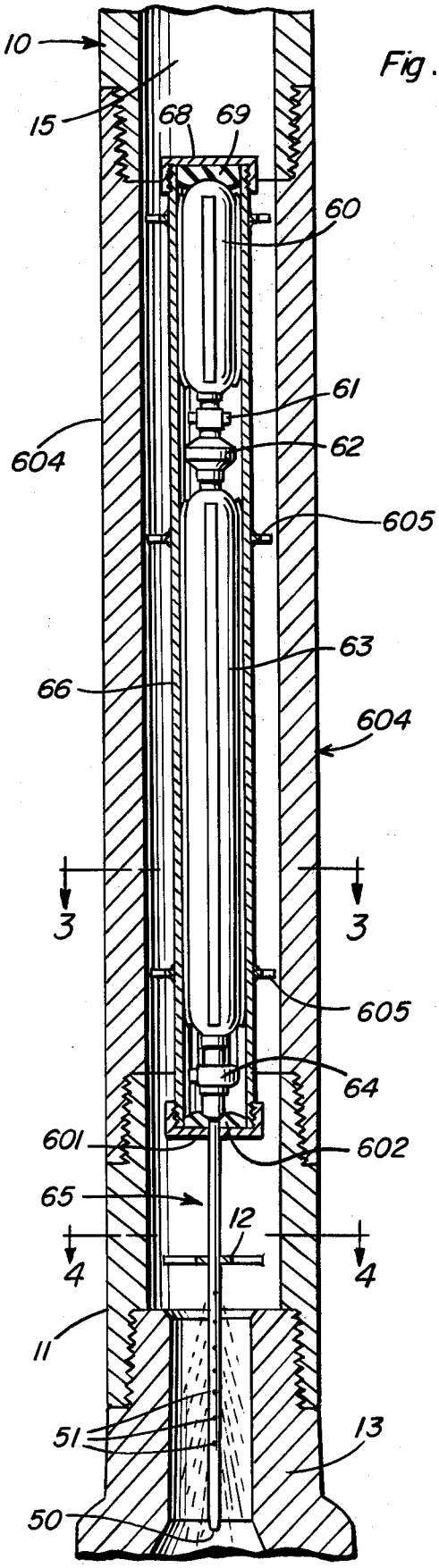
FIG. 2 is a partial sectional view of the device along plane 2—2 of FIG. 1.
Figure 3:
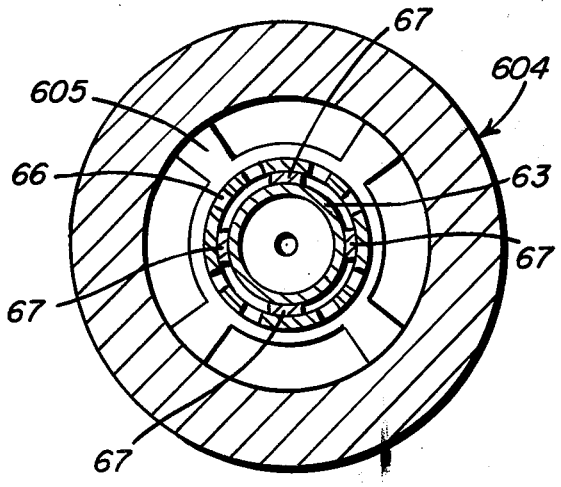
FIG. 3 is a sectional view of the device as seen along plane 3—3 of FIG. 2.
Figure 4:
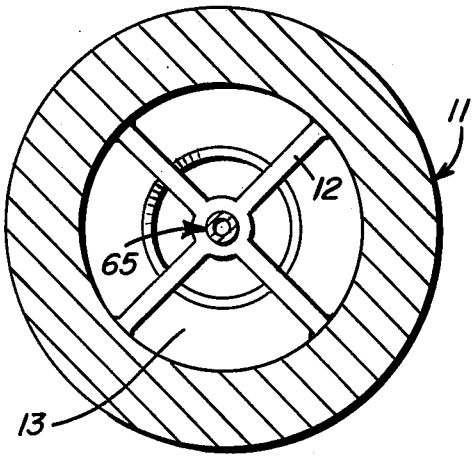
FIG. 4 is a sectional view of the device as seen along plane 4—4 of FIG. 2.

Now with reference to FIGS. 1 and 2, it can be seen that the forward end of drill string 10 is threadably engaged to the rear portion of casing rod 604. Here it can be seen that the casing rod diameter may be equal to or even slightly larger than the drill spring thus enabling it to act as a portion thereof. Threadably engaged to the forward portion of casing rod 604 is a sub adapter 11. Incorporated in adapter 11 is a stabilizing spider 12 for stabilizing nozzle 65. Adapter 11 may be provided, if necessary, to enable the use of the invention with any type of rotary drill bit 13. As can be seen from these figures, adapter 11 is made of sufficient length to dispose nozzle 65 just within or slightly behind drill bit 13. As can be seen with reference to FIG. 1, bore hole 14 can be drilled with the entire apparatus of the present invention in place.

The operation of the entire system will now be described. In normal drilling operation, pressurized air or other drilling fluid is provided through the hollow center 15 of drill string 10. This pressurized air aids in the removal of debris as it is produced by drill bit 13. With the present invention in place, the pressurized air may flow around mounting cylinder 66 past spiders 605 and communicate directly with drill bit 13. If during the drilling process the interior of drill bit 13 becomes clogged with finely ground gravel, clay, or any other substance, the ambient pressure on the inside of drill rod 10 and casing rod 604 will begin to rise as the air flow therethrough ceases. This increase in pressure is communicated to pressure actuated valve 64 by means of slots 603 and effects the operation thereof. When the drill bit is known to be clogged, actuation of valve 64 may be insured by an increase in the ambient pressure within drill string 10 effectuated by the operator of the drill rig. Pressure actuated valve 64 would advantageously have an hysteresis characteristic with an opening pressure of, for example, 140 psi and a closing pressure of, for example, minus 140 psi. Thus when the ambient pressure reaches 140 psi, pressure actuated valve 64 would open allowing the liquid stored in liquid storage tank 63, which is under of pressure of, for example, 1,000 psi, to flow through nozzle 65 and out holes 50 and 51. The liquid flowing at such a high pressure through the small holes would be necessarily moving at a high velocity, thus eroding away the material clogging the drill bit. Under severe conditions, a long plug may be broken first at the nozzle tip, then successively upstream by the auxiliary nozzles. When the plug is broken, air flow is restablished and the ambient pressure drops which allows pressure actuated valve 64 to close, whereupon further drilling may be accomplished. At this time the device of this invention is still in place and ready for further use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a drill string containing a drill bit, a drill unplugging apparatus comprising: a source of high pressure gas, a source of liquid in operative communication with said high pressure gas, whereby said liquid is maintained at a high pressure, a valve means connected to said source of liquid, and a nozzle means connected to said valve means and having at least one dispensing hole disposed thereon through which said liquid is forced at a high rate of speed when said valve means is opened, and further wherein said valve means is a pressure actuated valve which opens in response to pressure within said drill string rising above a predetermined maximum and closes in response to said pressure falling below a predetermined minimum.

2. The apparatus as claimed in claim 1 and further wherein a pressure regulator is disposed between said source of high pressure gas and said source of liquid such that said liquid is held at a constant pressure regardless of the pressure of said high pressure gas.

3. The apparatus of claim 1 and further wherein said nozzle means is of elongated tubular configuration with one end of said tube attached to said valve means and having a main stream hole disposed through the center thereof for a main stream of liquid to flow through and further wherein said tube contains a plurality of smaller holes disposed along the length and about the perimeter thereof, wherein said smaller holes are angled away from said valve means.

4. A drill unplugging apparatus comprising; a source of high pressure gas, a source of liquid in operative communication with said high pressure gas, whereby said liquid is maintained at a high pressure, a valve means connected to said source of liquid, and a nozzle means connected to said valve means and having at least one dispensing hole disposed thereon through which said liquid is forced at a high rate of speed when said valve means is opened, and further wherein said apparatus is disposed within a hollow casing rod and further in combination with a drill bit and a drill string, wherein one end of said casing rod is attached to said drill string and the opposite end thereof is attached to said drill bit such that said nozzle protrudes from said casing rod and is positioned within or immediately behind said drill bit.

5. The combination as claimed in claim 4 and further wherein said apparatus is mounted within said casing rod by being disposed on the inside of a mounting cylinder and further wherein said mounting cylinder is located and stabilized within said casing rod by stabilizing spiders having rigid portions which are firmly attached to and laterally disposed upon the outside of said mounting cylinder and firmly attached to the inside of said hollow casing rod.

6. The combination as claimed in claim 4 wherein said valve means is a pressure actuated valve which opens in response to the pressure inside the drill string rising above a predetermined maximum and closes in response to said pressure falling below a predetermined minimum.

7. The combination as claimed in claim 6 and further wherein a pressure regulator is disposed between said source of high pressure gas and said source of liquid such that said liquid is held at a constant pressure regardless of the pressure of said high pressure gas.

8. The combination of claim 4 and further wherein said nozzle means is of elongated tubular configuration with one end of the tube attached to said valve means and having a main stream hole disposed through the center thereof and further where said tube contains a plurality of smaller holes disposed along the length and about the perimeter thereof, wherein said smaller holes are angled away from said valve means and toward said drill bit.

* * * * *